United States Patent [19]

Abodishish et al.

[11] Patent Number: 4,954,166

[45] Date of Patent: Sep. 4, 1990

[54] PRODUCTION OF SPONGE METAL FROM SPONGE METAL FINES

[75] Inventors: Hani A. M. Abodishish; Randy W. Wahlquist, both of Ogden; Dale A. Lopez, South Weber, all of Utah

[73] Assignee: Westinghouse Electric Corp., Pittsburgh, Pa.

[21] Appl. No.: 437,948

[22] Filed: Nov. 17, 1989

[51] Int. Cl.[5] ..... C22B 5/02

[52] U.S. Cl. ..... 419/38; 419/356; 419/54

[58] Field of Search ..... 75/89, 63, 65 R, 67 R

[56] References Cited

U.S. PATENT DOCUMENTS 3,396,777 8/1968 Reding ..... 75/67 R 3,634,066 1/1972 Matthews ..... 75/65 R

*Primary Examiner*—Peter D. Rosenberg

[57] ABSTRACT

The pyrophoric fines inevitably resulting from the crushing of zirconium and/or hafnium or other exotic metal fines, such as titanium and uranium, are brought into contact with molten magnesium or a molten mixture of magnesium and magnesium chloride in the usual vacuum distillation furnace so that their surfaces are wetted by the molten material, after which furnace temperature is dropped to solidify the molten material about the fines. Furnace temperature is then raised to that required to vaporize the magnesium and magnesium chloride, whereupon sintering of the fines takes place over a period of time.

8 Claims, No Drawings

PRODUCTION OF SPONGE METAL FROM SPONGE METAL FINES

BACKGROUND OF THE INVENTION

1. Field of the Invention

The invention is concerned with using zirconium and/or hafnium sponge metal fines and similar fines of other exotic metals, such as titanium and uranium, to economic advantage.

2. Description of the Prior Art

Zirconium and/or hafnium metal values are customarily placed in socalled "sponge" condition as part of the production of pure zirconium and/or hafnium metal from zircon sand. An impure regulus of zirconium and/or hafnium sponge metal containing some magnesium and magnesium chloride is produced by reducing zirconium and/or hafnium tetrachloride powder with magnesium and by heating the resulting mixture of zirconium and/or hafnium and magnesium and magnesium chloride in a vacuum distillation retort to distill off most of the magnesium and magnesium chloride with other volatile impurities. The regulus of zirconium and/or hafnium sponge is crushed to break it into size suitable as feed to a melting step in the production of an ingot of useable zirconium and/or hafnium metal.

About five to ten percent by weight of unusable and highly pyrophoric fines (e.g. minus twenty mesh standard Tyler screen) are produced during crushing. The only known way to utilize these fines is to burn them into zirconium and/or hafnium oxide and add the oxide to zircon sand in a chlorination step of the overall process. However, by this practice, the value of the sponge constituting the fines is essentially lost.

SUMMARY OF THE INVENTION

A principal objective in the making of the present invention was to find a way to make economically effective use of the sponge fines that result from the sponge-crushing step in the production of zirconium and/or hafnium or other exotic metals.

In accordance with the invention, normally unusable and hazardous fines of zirconium and/or hafnium metal sponge or of other exotic metal sponges are brought into contact with molten magnesium or a molten mixture of magnesium and magnesium chloride in the usual vacuum distillation furnace under an atmosphere of helium gas so that their surfaces are wetted by the molten material, after which the temperature of the furnace is dropped below the melting point of such material, resulting in solidification of the charge in the furnace. This solidified charge is then reheated to a temperature at which the magnesium or the magnesium and magnesium chloride vaporize (900°-1040° C.), whereupon sintering of the metal fines takes place during a period of substantially ten hours or longer. The fines are fused together during this sintering step to produce a metal sponge product similar to that produced in the customary manner.

DETAILED DESCRIPTION OF THE PREFERRED PROCEDURE

The best mode presently contemplated for carrying out the invention is to utilize a usual vacuum distillation furnace and to place the sponge fines on top of a mixture of magnesium (about 65% by weight) and magnesium chloride (about 35% by weight) solids within the furnace, such mixture having a weight within the range of from about 20% to about 75%, preferably about 42%, of the weight of the fines. The furnace is then heated to a temperature and for a time period that will remove all moisture from the charge, whereupon furnace temperature is increased to melt the magnesium and magnesium chloride and to thereby permit the sponge fines to drop into the pool of molten magnesium and magnesium chloride. Furnace temperature is then dropped to below the melting point of the magnesium and magnesium chloride so that they solidify about the sponge fines. Furnace temperature is then raised sufficiently to vaporize the magnesium and magnesium chloride and is held at that temperature for a time period sufficient to sinter the sponge fines into a sponge compact which, after cooling, can be crushed to appropriate size for vacuum melting in the usual manner. It has been found that this crushing produces less than five percent fines by weight.

EXAMPLE

A pilot run of the process of the invention was made in a vacuum/ATM distillation furnace of the Western Zirconium Company (Westinghouse Electric Corporation) plant at Ogden, Utah.

Two batches of zirconium sponge fines, each 1200 pounds of −20 mesh, were placed in respective stainless steel pans. A charge of 400 pounds of magnesium in powder form was added to one of the pans and a charge of 550 pounds of mixed magnesium (65% by weight) and magnesium chloride (35% by weight) powder was added to the other. The first batch was placed in the middle position in the furnace and the other was placed in the top position.

Furnace vacuum was pulled in customary manner and the furnace hot top installed. The temperature cycle was started at a pressure of twenty-two inches of mercury in the hot top. Heat in the furnace was maintained at 300° C. for a period of ten hours, whereupon furnace temperature was increased to 450° C. for a period of twenty-two hours.

The furnace and hot top were then backfilled in the normal manner, using low pressure helium to hold pressure. The hot top vacuum connector hose was then disconnected and a one-third pound per square inch check valve installed on the room air line inside the control panel so that pressure could be bled from the furnace. The room air valve was opened so that pressure would be bled off slowly through the check valve and was then shut sufficiently for the low pressure helium to hold steady at a pressure of approximately one and a half pounds per square inch. Pressure should not exceed two p.s.i.

Furnace heat was increased to 750° C. and maintained at that temperature for a period of ten hours, whereupon heat was decreased so that furnace temperature dropped to 350° C. which was maintained for a period of four hours. After this, the hot top vacuum line was hooked up, the check valve was removed, and vacuum was pulled in furnace and hot top in normal manner to prepare for distillation, furnace heat still being at 350° C.

Furnace heat was then raised to 750° C. and maintained at that temperature for ten hours, after which furnace heat was raised to maintain furnace temperature at 900° C. for thirty hours and then to maintain furnace temperature at 960° C. for ten hours. The power for furnace heating was then turned off and the furnace backfilled and cooled.

The pan that included both magnesium and magnesium chloride and that had been place in the top position in the furnace was found to contain normal zirconium metal sponge, while the other pan that included only magnesium and that had been placed in the middle position in the furnace was found to contain zirconium metal sponge of grainy appearance but otherwise normal. On breakup of these two different metal sponges, fines were less than five percent by weight in each instance.

Since the metal sponge in the pan containing both magnesium and magnesium chloride was completely normal, two samples were taken from it for chemical analysis. They analyzed as follows:

| Element | 1st Sample (PPM) | 2nd Sample (PPM) |
|---|---|---|
| Al | 170 | 451 |
| Si | 26 | 59 |
| Cr | 84 | 41 |
| Fe | 1338 | 892 |
| Ni | 20 | 20 |
| Nb | 10 | 12 |
| Ti | 25 | 50 |
| Ta | 100 | 100 |
| Hf | 11072 | 22732 |
| O | 4617 | 4372 |
| Cl | 100 | 96 |
| BHN (Bernell hardness) | 252 | 253 |

These analyses are typical of crude zirconium-hafnium sponge, except for the high oxygen content and Bernell hardness. Oxygen level is directly related to particle surface area, while the Bernell hardness level is indicative of high oxygen content.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim as our invention:

1. A process for the production of a sintered, coherent mass of sponge metal from sponge metal fines of a metal of a kind that can be produced in the form of sponge, comprising bringing said fines into contact with molten magnesium under conditions of temperature above the melting point of magnesium to wet the surfaces of said metal fines with said magnesium; lowering the temperature to or below the melting point of magnesium so as to solidify said molten magnesium; and sintering and fusing together the metal fines by raising the temperature to or above the vaporization point of the magnesium, thereby distilling off said magnesium.

2. A process according to claim 1, wherein the metal fines comprise zirconium.

3. A process according to claim 1, wherein the metal fines comprise hafnium.

4. A process according to claim 1, wherein the metal fines comprise titanium.

5. A process according to claim 1, wherein the metal fines comprise uranium.

6. A process according to claim 1, wherein the fines are brought into contact with a molten mixture of magnesium and magnesium chloride under conditions of temperature above the melting point of said mixture; wherein the temperature is lowered to or below the melting point of said mixture so as to solidify said molten mixture; and wherein the temperature is then raised to or about the vaporization point of said mixture, thereby distilling off the magnesium and magnesium chloride.

7. A process according to claim 6, wherein the mixture contains about 65% by weight magnesium and about 35% by weight magnesium chloride and the weight of said mixture constitutes in the range of from about 20% to about 75% of the weight of the fines.

8. A process according to claim 6, wherein the weight of the mixture constitutes about 42% of the weight of the fines.

* * * * *